US005904092A

United States Patent [19]

Lyga

[11] Patent Number: 5,904,092

[45] Date of Patent: May 18, 1999

[54] DRIVE MECHANISM FOR A SHUTTER BAR OF A POSTAGE METER

[75] Inventor: Thomas M. Lyga, Torrington, Conn.

[73] Assignee: Pitney Bowes Inc., Stamford, Conn.

[21] Appl. No.: 09/036,340

[22] Filed: Mar. 6, 1998

[51] Int. Cl.[6] ..... G07B 17/04

[52] U.S. Cl. ..... 101/91; 400/61

[58] Field of Search ..... 705/408; 101/91; 400/120.04, 61, 663

[56] References Cited

U.S. PATENT DOCUMENTS

| | | | |
|---|---|---|---|
| 4,682,541 | 7/1987 | Pollak, Jr. et al. | 101/91 |
| 4,872,521 | 10/1989 | Abellana et al. | 400/33 |
| 5,049,727 | 9/1991 | Abellana et al. | 235/101 |
| 5,188,025 | 2/1993 | Murphy, III et al. | 101/93 |

*Primary Examiner*—Edgar Burr
*Assistant Examiner*—Daniel J. Colilla
*Attorney, Agent, or Firm*—Steven J. Shapiro; Melvin J. Scolnick

[57] ABSTRACT

A postage metering apparatus including a postage meter having a housing, a printing device disposed in the housing, an aperture in the housing exposing the printing device, a shutter bar mounted to the postage meter housing for movement from a closed position in which the shutter bar is disposed to cover the aperture and an open position in which the shutter bar is disposed away from the aperture, the shutter bar preventing access to the printing device through the aperture when the shutter bar is in the closed position and permitting access to the printing device when the shutter bar is in the open position; a base into which the postage meter is removeably inserted, the base including engaging structure for engaging the shutter bar; and driving structure for driving the engaging structure to move the cover between the closed and open positions, the driving structure including a motor, a drive shaft coupled to and driven into rotation by the motor and having a worm gear at one end thereof, a first pinion gear in meshing engagement with the worm gear, a first rack gear in meshing engagement with the first pinion gear and to which the engaging structure is fixedly connected and wherein at times when the motor is energized to drive the drive shaft into rotation the first rack gear is forced to move via the pinion gear and the worm gear carrying the first engaging structure with it and correspondingly the shutter bar.

5 Claims, 6 Drawing Sheets

DRIVE MECHANISM FOR A SHUTTER BAR OF A POSTAGE METER

BACKGROUND OF THE INVENTION

The invention relates to postage meters, and more particularly to flat-bed printing meters, and to security and control devices therefor.

Electronic meters of the flat-bed printer type are well-known and are described for example in U.S. Pat. No. 4,579,054, issued to Buan, et al. which shows a stand-alone electronic mailing machine in which the electronic postage meter forms an integral part of the device. Other aspects of such a stand-alone mailing machine are described in U.S. Pat. Nos. 4,535,407 and 4,523,523, among others.

Of particular concern in postage meters and mailing machines is the prevention of unauthorized printing of a meter impression (postage indicium). That is, since the printing of the postage indicium assumes that the Post Office has been paid for the delivery of the mailpiece, printing of the postage indicium without accounting for its value will result in loss of revenue to the Post Office to cover the costs of delivery. It will be appreciated that in an area of such concern, many devices have been developed to solve problems associated with the security of the printing die.

Die protection assemblies incorporate various mechanical arms of projections which protrude from the printwheel area of the die in order to prevent a person from simply placing an envelope against the die to obtain an imprint.

U.S. Pat. No. 2,795,186, issued to Bach, shows a movable shroud which can be lowered to guard the printing die against taking unauthorized impressions at any time between printing operations. The shroud completely covers the face of the value printing die when the printing mechanism is not in an operating cycle and is locked in that position until the cycle starts at which time the shroud is moved to a position uncovering the die. U.S. Pat. No. 4,559,444 issued to Erwin, et al. teaches an interposer arrangement which extends upward from the platen into the space into which an envelope or other workpiece is to be inserted. These interposers are moved out of the way during a legitimate printing operation. The interposer blades are mechanically linked to the inking mechanism in order to move the blades out of the way as the mailpiece moves into position for imprinting. U.S. Pat. No. 4,796,527 describes an interposer device which is linked to the motor driving the platen of the printer to move out of the way or is actuated by a power switch to be moved out of the way so long as power is applied to the machine.

While these known devices work well in the particular environments in which the platen and the die are not expected to be physically separated, in a modular device where the platen is retained, several new security and control issues are created in respect of a flat-bed printer type of postage meter. Accordingly, U.S. Pat. No. 5,049,727, issued to Abellana, et al, describes a postage meter having a moveable shutter which is driven by a drive mechanism between a first position which covers the postage meter printing die and a second position which permits the printing die to be exposed through an opening in the postage meter base to permit printing of a postage indicia. The shutter bar drive mechanism also serves the function of unlatching the postage meter from a locked position so that it can be removed from its associated mailing machine for inspection, repair, or to permit access to certain mailing machine components.

While the shutter bar drive mechanism of U.S. Pat. No. 5,049,727 has performed admirably over the years, its design is such that, under certain circumstances, it is possible the shutter bar will become cocked and bind or alternatively result in only a partial unlocking of the postage meter from the mailing machine. Thus, what is needed is an improved drive mechanism for a shutter bar of a postage meter having a flat-bed printer which overcomes the problems of the drive mechanism described in U.S. Pat. No. 5,049,727.

SUMMARY OF THE INVENTION

It is an object of the invention to provide a drive mechanism for a shutter bar which overcomes the problems discussed above in connection with the prior art devices.

The above object is met by providing a postage metering apparatus including a postage meter having a housing, a printing device disposed in the housing, an aperture in the housing exposing the printing device, a shutter bar mounted to the postage meter housing for movement from a closed position in which the shutter bar is disposed to cover the aperture and an open position in which the shutter bar is disposed away from the aperture, the shutter bar preventing access to the printing device through the aperture when the shutter bar is in the closed position and permitting access to the printing device when the shutter bar is in the open position; a base into which the postage meter is removeably inserted, the base including engaging means for engaging the shutter bar; and driving means for driving the engaging means to move the cover between the closed and open positions, the driving means including a motor, a drive shaft coupled to and driven into rotation by the motor and having a worm gear at one end thereof, a first pinion gear in meshing engagement with the worm gear, a first rack gear in meshing engagement with the first pinion gear and to which the engaging means is fixedly connected and wherein at times when the motor is energized to drive the drive shaft into rotation the first rack gear is forced to move via the pinion gear and the worm gear carrying the first engaging means with it and correspondingly the shutter bar.

Objects and advantages of the invention are set forth in the description, which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DESCRIPTION OF THE PREFERRED EMBODIMENTS

Figure 1:
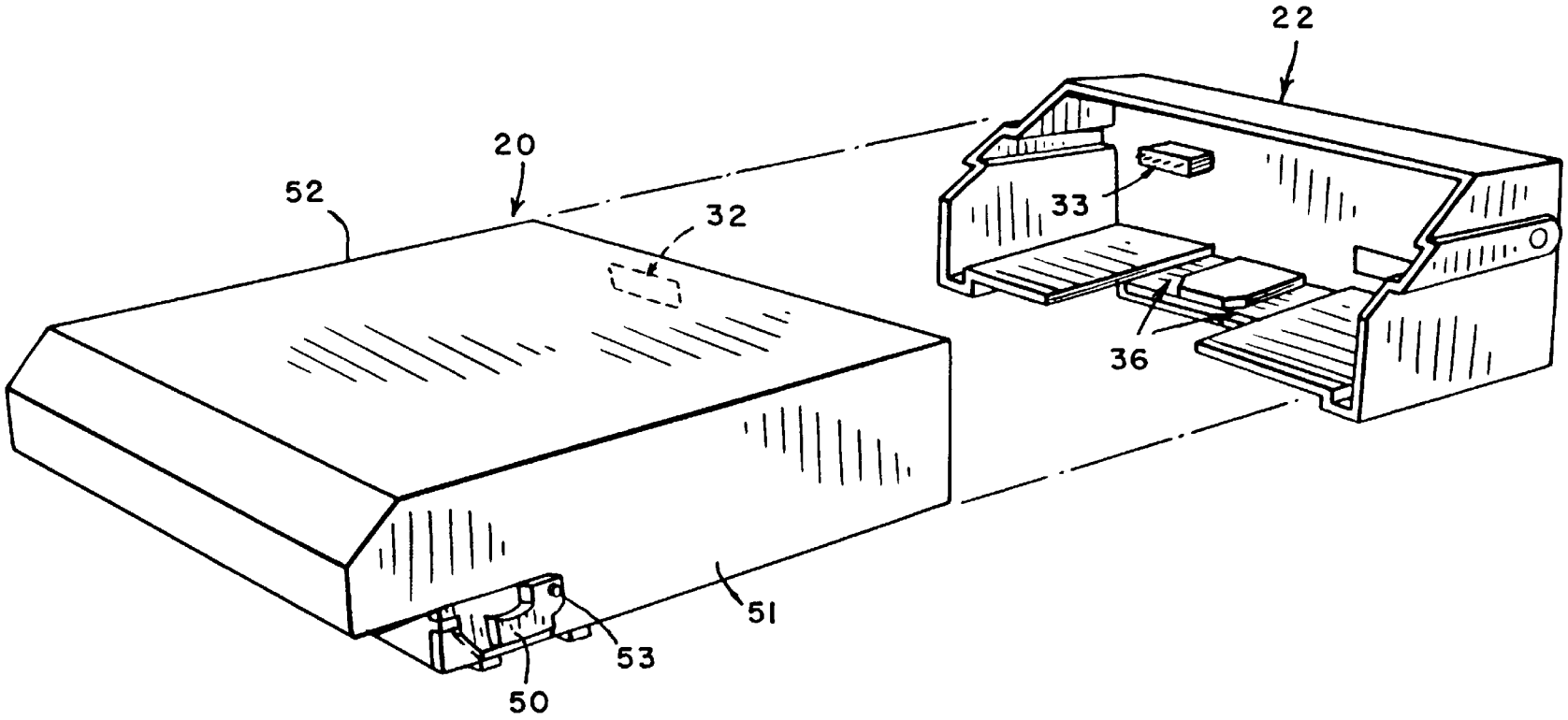
FIG. 1 is a top, exploded perspective view of a known postage meter and a known meter pocket into which the postage meter is seated for use in a mailing machine.
Figure 2:
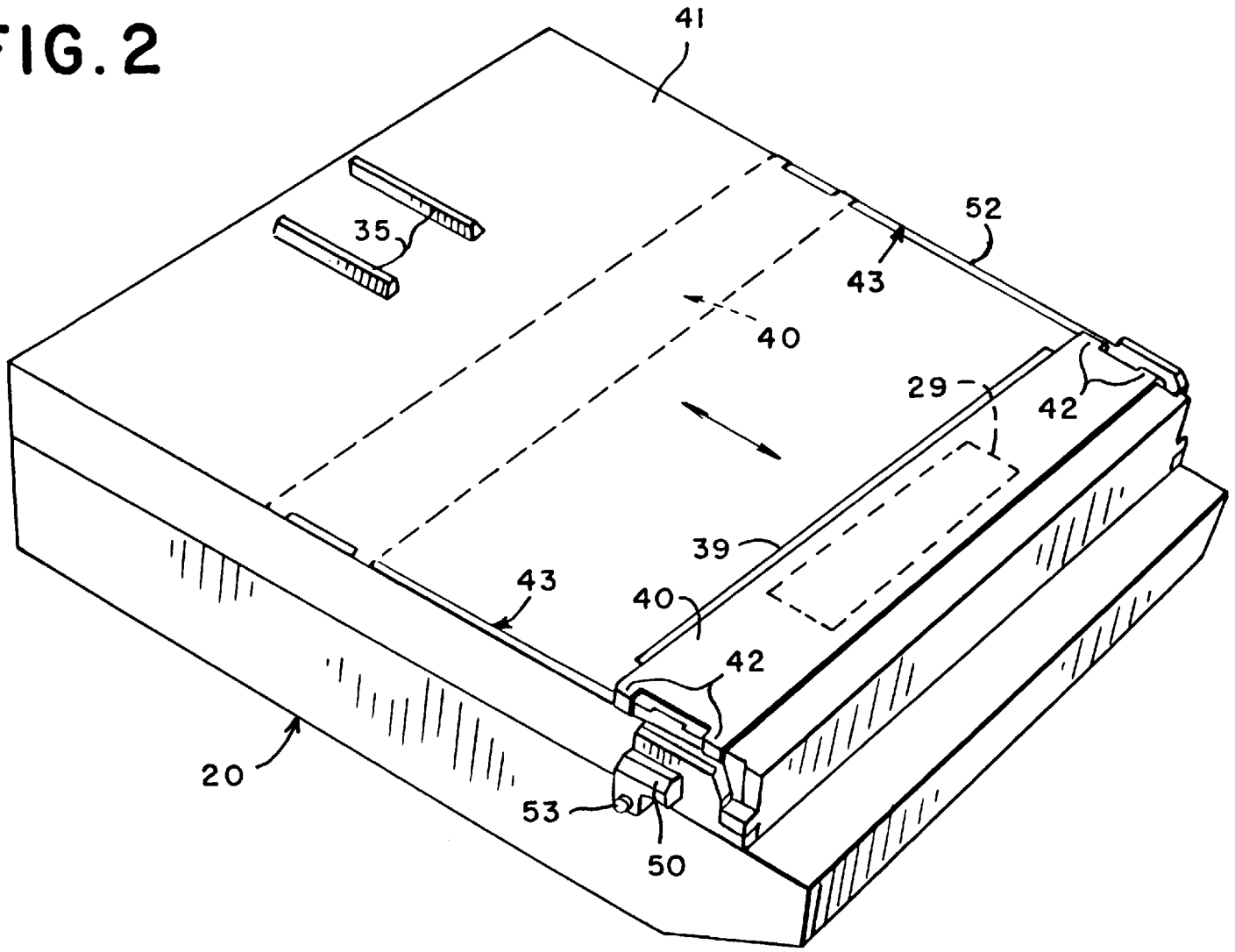
FIG. 2 is a bottom perspective view of the postage meter depicted in FIG. 1.
Figure 3:
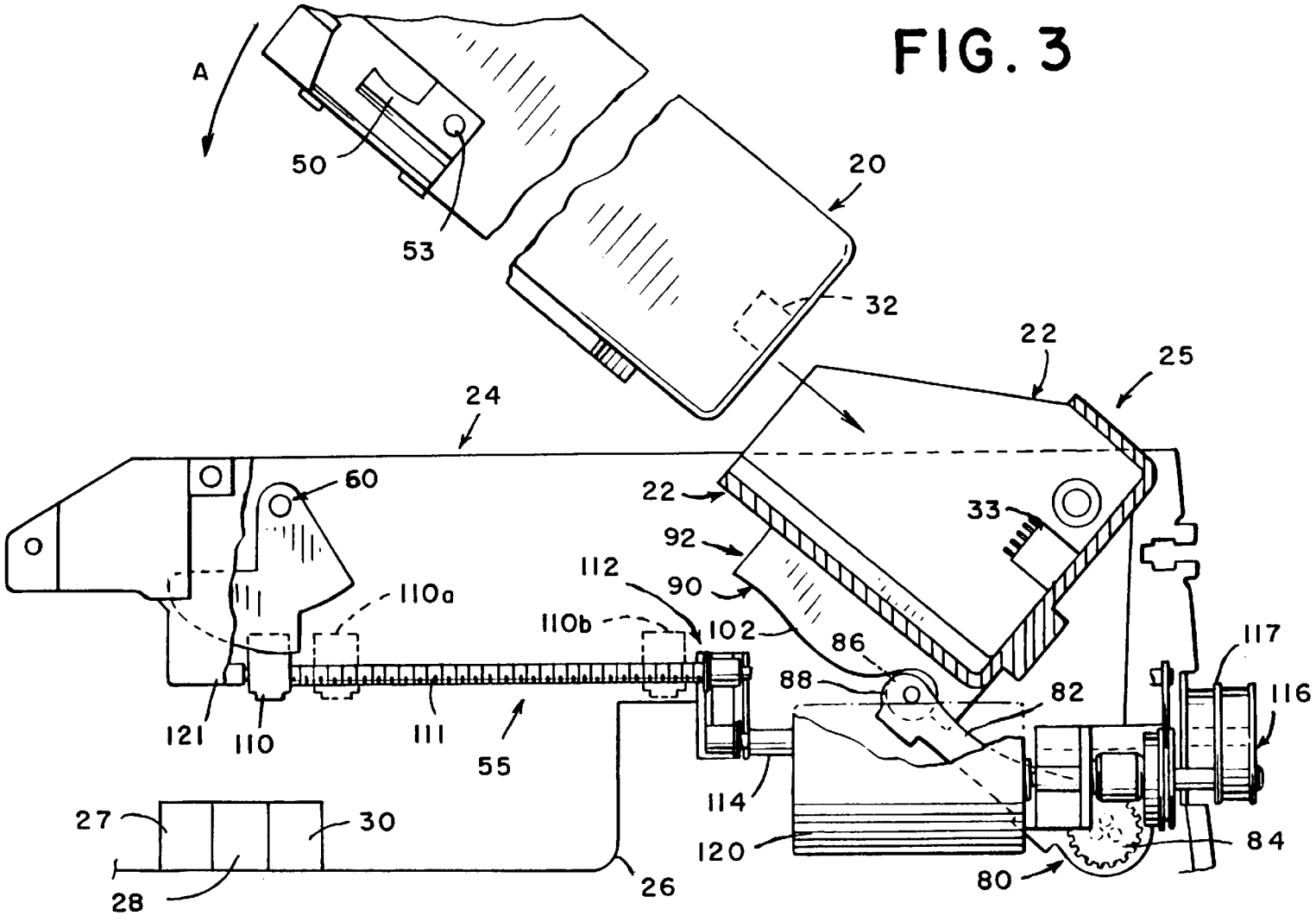
FIG. 3 is a side view, partially in section, of the postage meter and meter pocket depicted in FIG. 1 and a locking device of a mailing machine into which the postage meter and meter pocket are seated and locked, the postage meter and the meter pocket being shown exploded as in FIG. 1.

Referring to FIGS. 1–3, a postage meter 20 is insertable and removable from postage meter pocket 22, which in turn is pivotally mounted to a postage meter locking device 24. Meter pocket 22 and locking device 24 form a base 25 for postage meter 20. Postage meter 20 includes, as known in the art, a printing die 29 of a printing mechanism for printing a postage indicia and related indicia such as a town seal, slogans, advertising, etc., and known circuitry and structure for setting the printing mechanism to print desired indicia, entering authorized postage amounts, and for record keeping of various items such as postage dispensed, postage remaining, etc. Locking device 24 forms part of a conventional mailing machine 26 which may include a transport device 27 which is used to transport envelopes to the postage meter 20, an inking device 28 which imparts ink to the print die 29 of the postage meter 20, and a platen device 30 which tamps an ink pad of the inking device 28 against print die 29 to ink it, and also tamps a mailpiece or tape against print die 29 to imprint postage and other indicia thereon. The mailing machine and various parts thereof are shown schematically but are fully described in U.S. Pat. No. 4,935,078 which is incorporated herein by reference. Postage meter 20, meter pocket 22 and locking device 24 may also be constructed as a module to be utilized alone or as part of a larger machine.

Postage meter 20 and meter pocket 22 include mating connectors 32, 33 by means of which signals are exchanged between postage meter 20, locking device 24, and, in the disclosed embodiment, among meter 20, locking device 24 and mailing machine 26. Connectors 32, 33 also supply power to postage meter 20. Referring to FIGS. 1 and 2, postage meter 20 and meter pocket 22 include mating dovetail structure 35, 36 for aligning postage meter 20 in meter pocket 22. Postage meter 20 may be unseated from meter pocket 22 and removed for postage recharging, inspection, servicing, etc., or for gaining access to parts of mailing machine 26 for servicing, ink replenishment, etc.

Referring to FIG. 2, postage meter 20 includes a shutter bar or cover 40 which in its closed solid line position covers print die 29 to protect same, prevent unauthorized use of postage meter 20 and inhibit tampering. Shutter bar 40 is movable to its open position, illustrated by broken lines in FIG. 2, via the sliding of prongs 42 of shutter bar 40 within shutter bar guide slots 43 to expose print die 29 through opening 39 in a bottom surface 41 of postage meter 20.

Referring to FIG. 3, meter 20 is loaded and locked into place by locking device 24 by first seating postage meter 20 in meter pocket 22 and then pivoting (along arrow A) meter 20 seated in pocket 22 into locking device 24. Once postage meter 20 is locked into locking device 24, shutter bar 40 may be retracted to its open position by a drive mechanism 55 such that postage meter 20 is ready to imprint postage indicia on mailpieces and/or tape.

Referring to FIGS. 1–3, postage meter 20 includes a locking section 50 on each side 51, 52, thereof. Each locking section 50 includes a pin 53 which engages a corresponding latch mechanism 60 of locking device 24 during rotation of the postage meter 20 into locking device 24. This causes latch mechanism 60 to rotate and engage with locking section 50 thereby locking the postage meter 20 to the base 25 as more fully described in U.S. Pat. No. 5,049,727 which is incorporated herein by reference.

Referring to FIG. 3, meter pocket 22 is mounted to locking device 24 by a counterbalance mechanism 80 which includes a counterbalance arm 82 fixed to a torsion bar 84. Pivoting of arm 82 in the counterclockwise direction of FIG. 3 applies torsion to the torsion bar 84 which resists pivoting and urges arm 84 back toward its rest position depicted in FIG. 3. Roller 86 is rotatably mounted to an end 88 of arm 82 to ride along a cam surface 90 of a counterbalance cam 92 which is attached to the bottom 41 of meter pocket 22. Thus, when meter 20 and pocket 22 are pivoted against the force of counterbalance torsion bar 84 to lower meter 20 into locking device 24, postage meter 20 and meter pocket 22 are mechanically locked in locking device 24 by the locking section 50 which is urged upwardly by the action of torsion bar 84 against latch mechanism 60. On the other hand, when the latch mechanisms 60 are disengaged from locking sections 50, the torsion bar 84 pivots counterbalance arm 82 clockwise. This, in turn, causes counterbalance arms 92 to follow roller 86 thereby raising postage meter 20 and pocket 22 about 1 inch which indicates to the operator that postage meter 20 is in its unlocked position.

Figure 4:
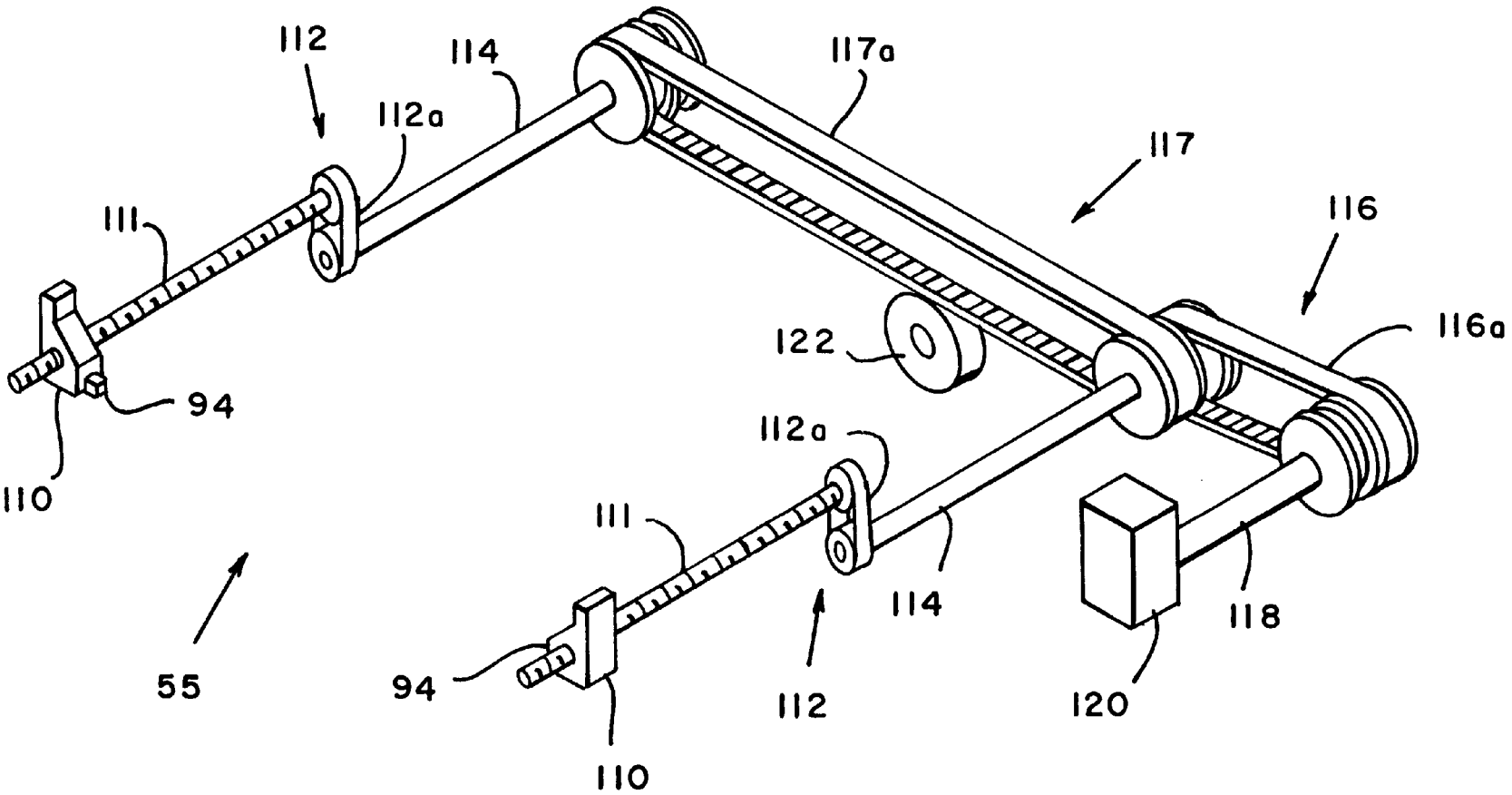
FIG. 4 (PRIOR ART)
FIG. 4 is a simplified perspective view of the complete shutter bar drive system of the mailing machine of FIG. 3.

Referring to FIGS. 3–4, drive mechanism 55, for moving shutter bar 40 between its open and closed positions, comprises on each side of locking device 24, a shutter bar carrier 110, a lead screw 111, a belt coupler 112 and shaft 114. Additionally, belt transmission mechanisms 116, 117, a motor take-off shaft 118 and bi-directional drive motor 120 impart torque to the drive shafts 114. Bearings 121 support lead screws 111 and a belt tensioner 122 provides tension to a belt 117*a* of belt coupler 117.

The shutter bar carriers 110 each engage shutter bar 40 and upon rotation of lead screws 111 move shutter bar 40. Shutter bar carriers 110 include a prong or projection 94 which is received between the prongs 42 of shutter bar 40 for engaging shutter bar 40 to move it. Shutter bar carriers 110 are threaded to lead screws 111 which in turn are coupled to and rotated by motor 120 to advance shutter bar carriers 110 along lead screws 111. Motor 120 is coupled to lead screws 111 by motor take-off shaft 118, the belt couplers 116 and 117, drive shafts 114, and couplers 112. The belt couplers 112 are used to couple lead screw 111 and shafts 114 rather than having lead screw 111 run the full distance to belt couplers 116 and 117 in order to reduce the overall length of lead screws 111. The rotation of motor 120 causes the lead screws 111 on both sides of locking device 24 to rotate thereby advancing shutter bar carriers 110 on each side of the locking device 24. As depicted in FIG. 3, the shutter bar carriers 110 are moveable between the solid line position, a first broken line position 110*a* and a second broken line position 110*b*. In the position 110*a* the shutter bar 40 covers the printing die 29 while in the position 110*b* the shutter bar 40 no longer covers the printing die 29 to allow printing of the postage indicia. The solid line position of FIG. 3 shows the position of the carriers 110 at which point they contact a corresponding latch mechanism 60 and rotate the latch mechanism 60 out of a secure engagement with locking section 50 so that the postage meter 20 assumes an unlatched position under the force of torque bar 84.

As discussed above, the drive mechanism 55 performs the dual functions of moving the shutter bar 40 between two positions and advancing the shutter bar carriers 110 past the position 110*a* to unlatch the postage meter 20. However, in the drive mechanism 55 it is critical that the screw shafts 110 turn in unison so that the shutter bar carriers 110 translate equally. If the shutter bar carriers 110 do not translate equally the shutter bar 40 may cock and bind preventing further movement of the shutter bar 40 and requiring a service call to repair. Additionally, even if the shutter bar carriers 110 became cocked without causing the shutter bar 40 to bind, a partially unlatched meter condition may occur. That is, when meter 120 causes the shutter bar carriers 110 to move past position 110*a*, if the carriers 110 are not translated equally, one of the carriers 110 will engage its corresponding latching mechanism 60 before the other carrier engages its corresponding latching mechanism 60. Accordingly, only one latching mechanism 60 becomes unlatched preventing the postage meter 20 from being removed from the mailing machine 26.

The above discussed uneven translation of the carriers 110 sometimes occurs due to the use of the offset parallel drive shafts 114 in conjunction with the timing belt and pulley arrangements (116, 117) which were utilized to accommodate space constraints in the mailing machine 26. That is, the four sets of timing belt and pulley arrangements (112, 112, 116 and 117) respectively include timing belts 112*a*, 112*c*, 116*a* and 117*a*. Each of the timing belts (112*a*, 112*a*, 116*a* and 117*a*) are prone to skipping, which results in a loss of synchronicity between the shutter carriers 110. In addition to the above, each timing belt (112*a*, 112*a*, 116*a* and 117*a*) carries its own residual friction which results in higher than necessary static torque on drive meter 20 which can lead to a shortened life of drive motor 120.

Figure 5:
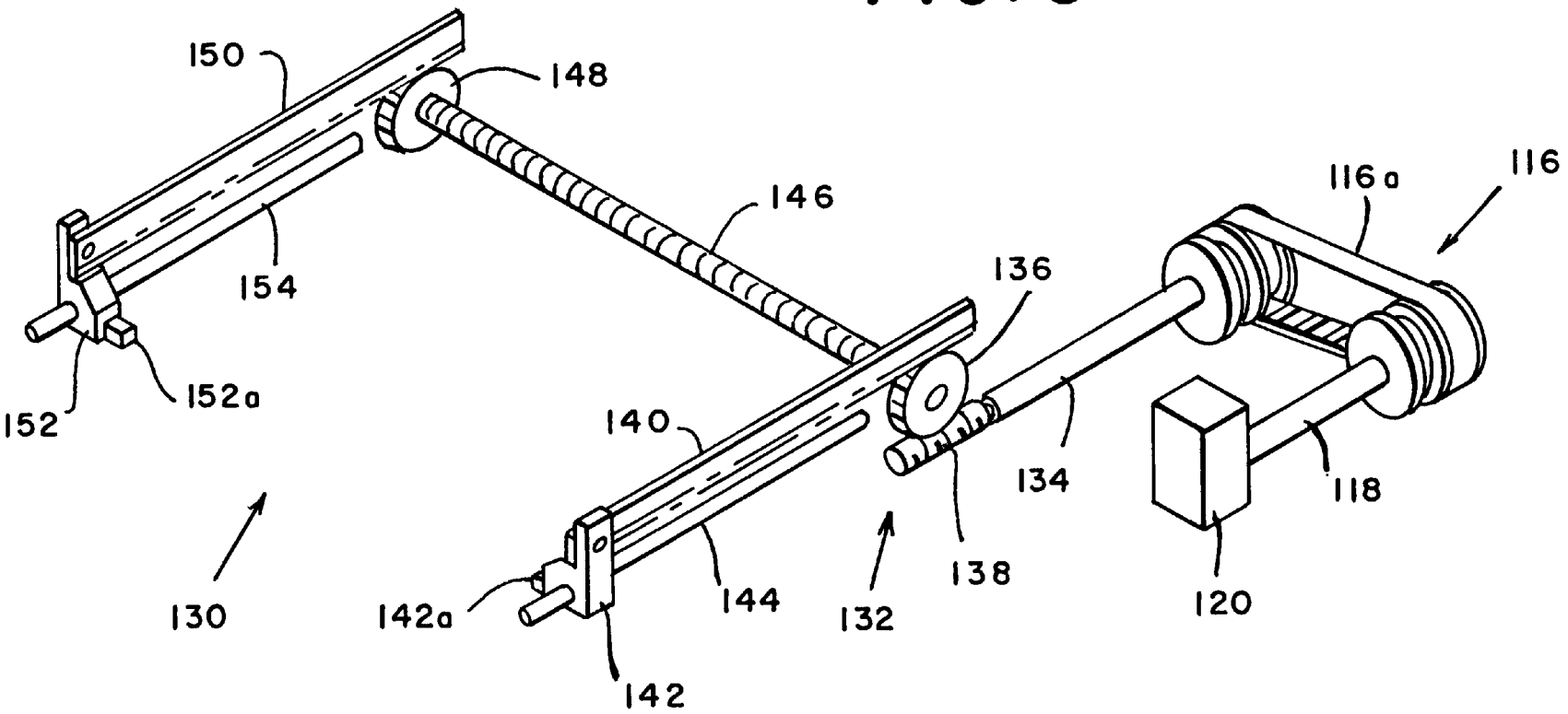
FIG. 5 is a perspective view of the inventive shutter bar drive mechanism.

Referring to FIG. 5, an improved drive mechanism is shown. Drive mechanism 130 was designed to not only overcome the problems discussed above in connection with drive mechanism 55, but also to fit within the physical constraints of the mailing machine 26 and to utilize the existing motor 120 to minimize any impact to the mailing machine production line and permit an easy retrofit of field units if desired. Drive mechanism 130 includes motor 120, and motor drive shaft 118 which is coupled to belt coupler 116 in the same manner as for drive mechanism 55. However, in drive mechanism 130 a twin rack and pinion apparatus 132 has been incorporated to replace the drive shafts 114, belt coupler 117, tensioner 122, belt couplers 112, and screw shafts 111. The twin rack and pinion apparatus 132 includes a drive shaft 134 coupled at one end to belt coupler 116 and at its other end to a first pinion gear 136 via a worm gear 138 machined into the other end of the drive shaft 134. A first rack gear 140 is in meshing engagement with worm gear 138 and has attached thereto a first carrier 142 at an end disposed outboard of pinion gear 136. The first carrier 142 is mounted to be slideable along a guide shaft 144 which itself is fixedly mounted in mailing machine 26 in a conventional manner.

Twin rack and pinion apparatus 132 further includes a flexible cross shaft 146 which is connected to pinion gear 136 at a first end thereof and to a second pinion gear 148 at its opposite end. Second pinion gear 148 is in meshing engagement with a second rack gear 150 which carriers a second carrier 152 at one end thereof. The second carrier 152 is mounted for slideable movement on a second guide shaft 154 which is fixedly mounted in mailing machine 26.

In operation, motor 120 drives drive shaft 134 into rotation via shaft 118 and belt coupler 116. Shaft 134 causes pinion gear 136 to rotate via its engagement with worm gear 138, which in turn causes pinion gear 148 to rotate synchronously with pinion gear 136 via flexible shaft 146. The rotation of pinion gears 136, 148 cause a lateral translation of the corresponding rack gears 140 and 150 to occur. As the rack gears 140 and 150 move, they respectively carry the carriers 142, 152 therewith. The carriers 142, 152 slide along their respective guide rods 144, 154 carrying the shutter bar 40 therewith due to the interference between the projections 142*a* and 152*a* of carriers 142, 152 and the projections 42 (FIG. 2) of shutter bar 40. The movement of the shutter bar 40 to cover end expose the print die 29 and to unlatch the postage meter 20 is accomplished as in the prior art. However, the synchronous movement of carriers 142, 152 is more readily assured. That is, since the rack and pinion system 132 can be made to much tighter tolerances than the timing belts of the prior art structure and does not stretch, the skipping problem of three of the four timing belts of the prior art structure has been eliminated. Additionally, the improved design reduces the friction torque load applied to motor 120 and reduces noise associated with the movement of the shutter bar 40. Moreover, the drive mechanism 130 has less parts and is easier to assemble and adjust.

Figure 6:
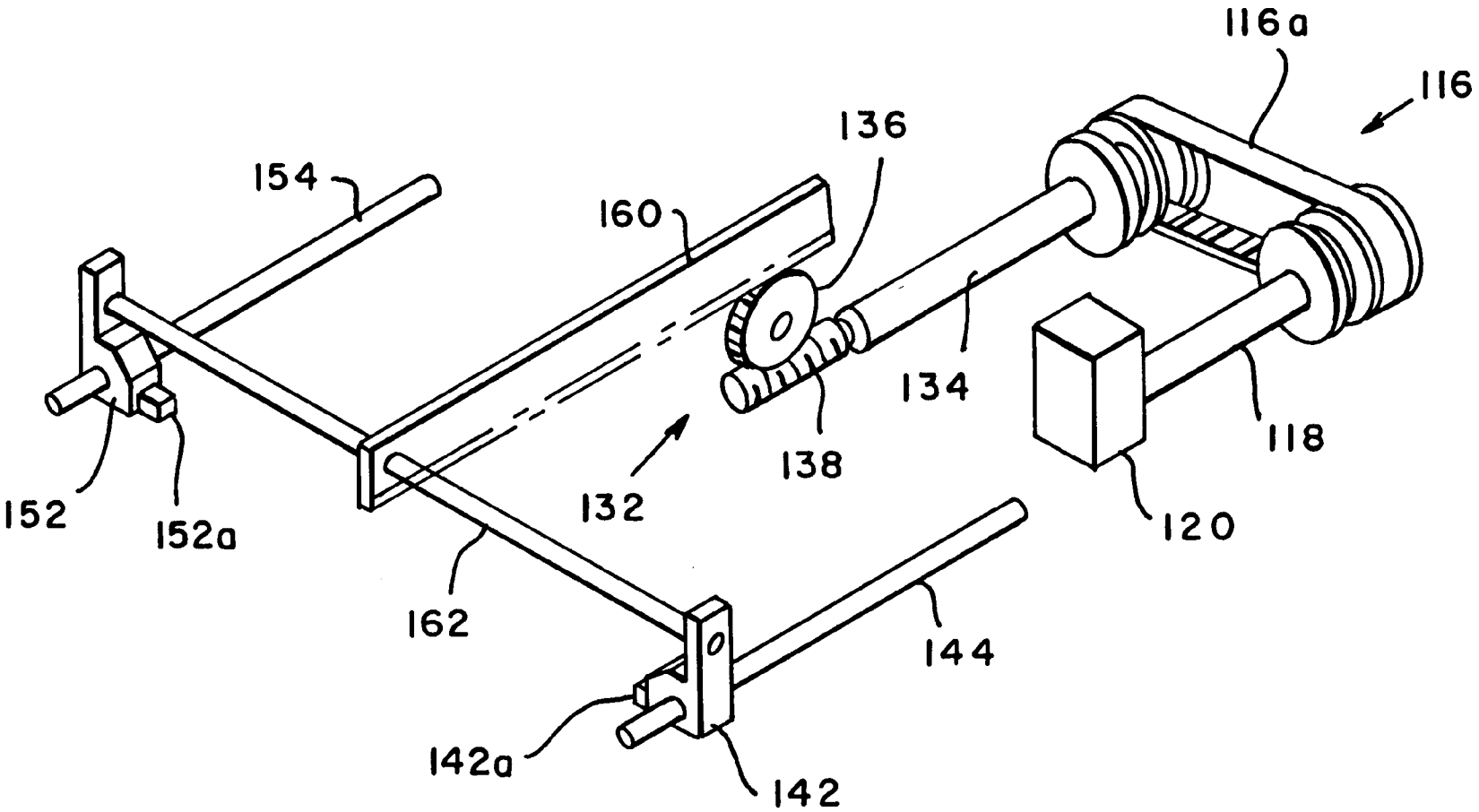
FIG. 6 is a second embodiment of the inventive drive mechanism.

An alternate embodiment of the invention is shown in FIG. 6 utilizes a single rack gear 160 in lieu of the two rack gears 140, 150 of FIG. 5 and eliminates the need for the flexible cross shaft 146. In FIG. 6, rack gear 160 is moved in a reciprocating manner via rotation of pinion gear 136. A bar 162 is fixedly connected at one end of rack gear 160. Bar 160 has carriers 142, 152 fixedly mounted at opposite ends thereof. Thus, as rack gear 160 moves in a reciprocating manner, the carriers 142, 152 move therewith along guide bars 144, 154 carrying shutter bar 40.

Additional advantages and modifications will readily occur to those skilled in the art. Therefore, the invention in its broader aspects is not limited to the specific details and representative devices, shown and described herein. Accordingly, various modifications may be made without departing from the spirit or scope of the general inventive concept as defined by the appended claims.

What is claimed is:

1. A postage metering apparatus comprising:

a postage meter including a housing, a printing device disposed in said housing, an aperture in said housing exposing said printing device, a shutter bar mounted to said postage meter housing for movement from a closed position in which said shutter bar is disposed to cover said aperture and an open position in which said shutter bar is disposed away from said aperture, said shutter bar preventing access to said printing device through said aperture when said shutter bar is in said closed position and permitting access to said printing device when said shutter bar is in said open position;

a base into which said postage meter is removeably inserted, said base including engaging means for engaging said shutter bar; and driving means for driving said engaging means to move said cover between said closed and open positions, said driving means including a motor, a drive shaft coupled to and driven into rotation by said motor and having a worm gear at one end thereof, a first pinion gear in meshing engagement with said worm gear, a first rack gear in meshing engagement with said first pinion gear and to which said engaging means is fixedly connected;

wherein when said motor is energized to drive said drive shaft into rotation said first rack gear is forced to move via said pinion gear and said worm gear carrying said first engaging means with it and correspondingly said shutter bar.

2. A postage metering apparatus as recited in claim 1, wherein said engaging means includes first and second carriers which each engage said shutter bar, said first carrier is fixedly connected to said first rack gear, said driving means further includes a second pinion gear, a cross shaft interconnecting said first and second pinion gears to each other, a second rack gear in meshing engagement with said second pinion gear and to which said second carrier is fixedly attached, and at times when said motor is energized to drive said drive shaft into rotation said first and second rack gears are forced to move via respective first and second pinion gears respectively carrying said first and second carriers therewith and correspondingly said shutter bar.

3. A postage metering device as recited in claim 2, further comprising first and second means for locking said postage meter to said base, and wherein at times when said driving means moves said first and second carriers respectively into engagement with said first and second locking means the first and second carriers cause said postage meter to become unlocked from said base.

4. A postage metering device as recited in claim 3, further comprising first and second guide bars fixedly mounted in said base, the first and second carriers respectively mounted for slideable movement on the first and second guide bars.

5. A postage metering device as recited in claim 4, wherein the drive means further comprises a take-off shaft coupled to said motor and a belt coupler coupled to said take-off shaft and said drive shaft.

* * * * *